US005433336A

United States Patent [19]

Kristoffersson

[11] Patent Number: 5,433,336

[45] Date of Patent: Jul. 18, 1995

[54] STORAGE CONTAINER

[75] Inventor: Karl-Gustaf Kristoffersson, Orkelljunga, Sweden

[73] Assignee: Perstorp AB, Perstorp, Sweden

[21] Appl. No.: 923,788

[22] PCT Filed: Feb. 28, 1991

[86] PCT No.: PCT/SE91/00162

§ 371 Date: Aug. 31, 1992

§ 102(e) Date: Aug. 31, 1992

[87] PCT Pub. No.: WO91/13002

PCT Pub. Date: Sep. 5, 1991

[51] Int. Cl.[6] ..... B65D 1/24

[52] U.S. Cl. ..... 220/531; 220/533; 220/534; 220/540; 220/542; 220/545

[58] Field of Search ..... 220/532, 533, 531, 534, 220/530, 529, 540, 541, 539, 542, 544–546; 206/561

[56] References Cited

U.S. PATENT DOCUMENTS 1,523,136 1/1925 O'Conner .
2,897,997 8/1959 Sitler .

FOREIGN PATENT DOCUMENTS 471723 6/1969 Switzerland .

*Primary Examiner*—Joseph Man-Fu Moy
*Attorney, Agent, or Firm*—Stevens, Davis, Miller & Mosher

[57] ABSTRACT

Storage container, preferably a storage tray (1) of plastic having detachable partition walls (2), the container being provided with opposite vertical recesses or pairs of vertical ledges (5) along the inner side of the two long sides (3, 4). The container (1) comprises an inwards directed horizontal ledge (6) at the top along the inner side of each of the two long sides (3, 4), locking means (7) arranged in the upper edge of the ledges (6) on the two long sides (3, 4) of the container (1) in connection with each recess or pair of ledges (5), partition walls (2) including a lower part (8) and an upper part (9) connected to each other by an integrated hinge (10), whereby the parts (8, 9 and 10) are made of plastic in one piece, the upper part (9) being provided with locking means (11) along each short side which locking means (1 1) arc intended to co-operate with the locking means (7) on the container (1). The partition walls (2) are installed in the container (1) by inserting the two vertical edges (12, 13) of the walls (2) into the rec uts or between the pairs of ledges (5), folding the upper part (9) of the partition walls along the hinge .(10) at an angle with the lower part (8) and bringing the locking means on the partition walls (1 i) into engagement with the locking means (7) on the container.

12 Claims, 7 Drawing Sheets

STORAGE CONTAINER

The present invention relates to a storage container, preferably a storage tray of plastic having detachable partition walls. The container is provided with opposite vertical recesses or pairs of vertical ledges along the inner side of the two long sides.

Storage containers of this kind have been produced previously with varying shape of the container and the partition walls. These containers have been provided with opposite vertical recesses or pairs of vertical ledges along the inner side of the container. Then the partition walls have been inserted vertically from above into the ledges or the recesses. However, at the designing of such storage containers there are often problems with the sides of the container, since they are not rigid enough. When the container has been filled with a certain amount of goods the two long sides are pressed outwards, whereby the detachable partition walls are coming loose from their holds. Containers which are placed on a shelf will also be squeezed against each other. This prevents a container from being pulled out.

The purpose of the present invention is to decrease or to set aside these drawbacks of the prior art.

According to the present invention a storage container, preferably a storage tray of plastic having detachable partition walls has been brought about. Along the inner side of the two long sides the container is provided with opposite vertical recesses or pairs of vertical ledges.

The storage container comprises an inwards directed horizontal ledge along the inner side of each of the two long sides. Locking means are arranged in the upper edge of the ledges on the two long sides of the container in connection with each recess or pair of ledges. The partition walls comprise a lower part and an upper part connected to each other by an integrated hinge, whereby the parts are made of plastic in one piece. The upper part is provided with locking means along each short side, which locking means are intended to co-operate with the locking means on the container.

The partition walls are installed in the container by inserting their two vertical edges into the recesses or between the pairs of ledges. Then the upper part of the partition walls is folded along the hinge at an angle with the lower part in such a way that the locking means on the partition wall are brought into engagement with the locking means on the container. Preferably the upper part of the partition walls is folded at an angle of about 90° with the lower part of said walls.

Usually the container is made of plastic such as polypropylene, polyethylene or impact resistant polystyrene. However, polypropylene is preferred due to its sound absorbing properties.

As mentioned above the storage container is provided at the top with an inwards directed horizontal ledge along the inner side of each of the long sides. These ledges assist in taking up strains which the container is exposed to at the use thereof. Moreover, the ledges contribute to a more rigid construction of the container.

Suitably the locking means on the container and the partition walls respectively co-operate by snap-in action. Then, preferably the locking means of the partition wall consist of snap-in heads while the locking means of the container consist of recesses in the upper edge of the inwards directed horizontal ledges on the container.

Usually these recesses consist of through going vertical holes in said horizontal ledges. Of course the shape of the recesses is adapted to the shape of the snap-in heads. In this way a partition wall which has been attached to the container will increase the rigidity of the long sides of the container.

The lower part of the partition wall is provided with recesses at the top corresponding to the shape of the ledges on the long sides. The vertical edges of the partition wall will thereby fit tightly to the long sides of the container. Preferably the lower part of the partition wall is provided with a label holder at the top. Then a label placed in the label holder will be kept in place when the upper part of the partition wall is folded and attached to the container.

Suitably the outer side of the bottom of the container is fitted with diagonal reinforcement ribs which are lower in the middle of the container than at the ends. Usually the ribs start at or near the corners of the container. The ribs can sometimes stop just before the crossing point of the diagonals.

By the above shape and location of the ribs, the bottom will be pressed down a bit more in the middle of the container than at the edges at a heavy load. This means that the long sides of the container will not be pressed outwards, since partition walls are used.

The invention will be explained further in detail in connection with the enclosed figures of which FIG. 1 shows a perspection view of one embodiment of the container without partition walls.

Figure 5:
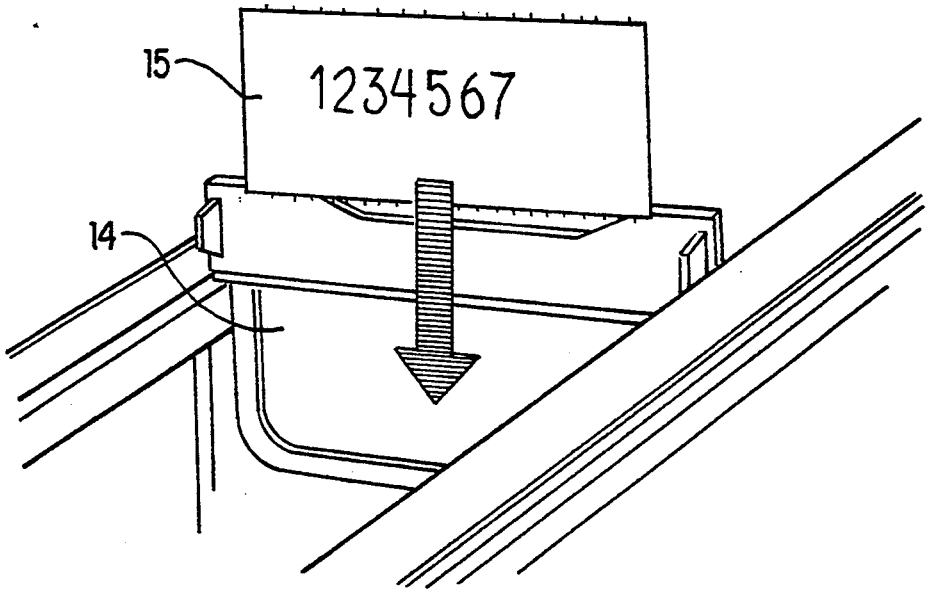
Figure 6:
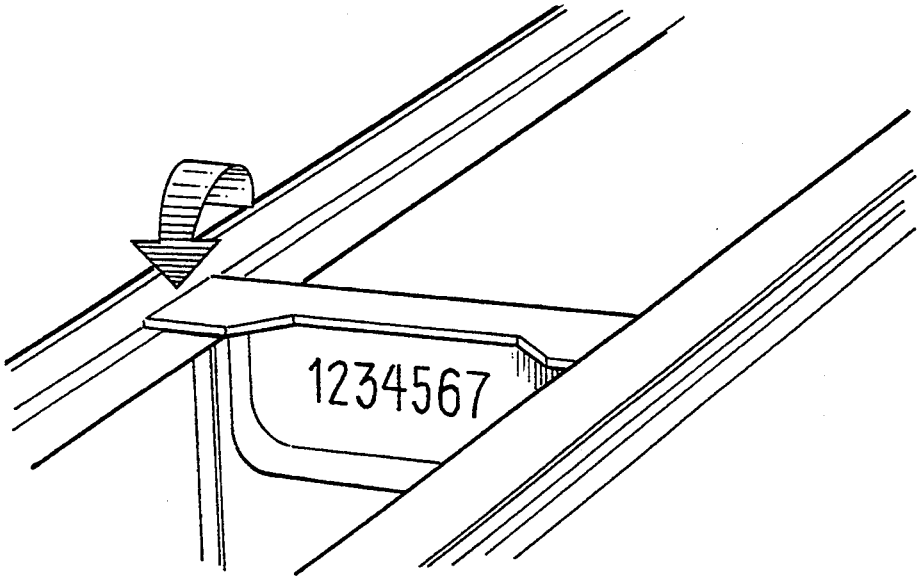

In FIGS. 5 to 6 it is illustrated how a label can easily be placed in the label holder respectively how the upper part of the partition wall is folded and attached to the container. Thereby the label is kept in place by said upper part. At the same time the walls of the container is reinforced and the partition wall is locked to the container.

Figure 7:
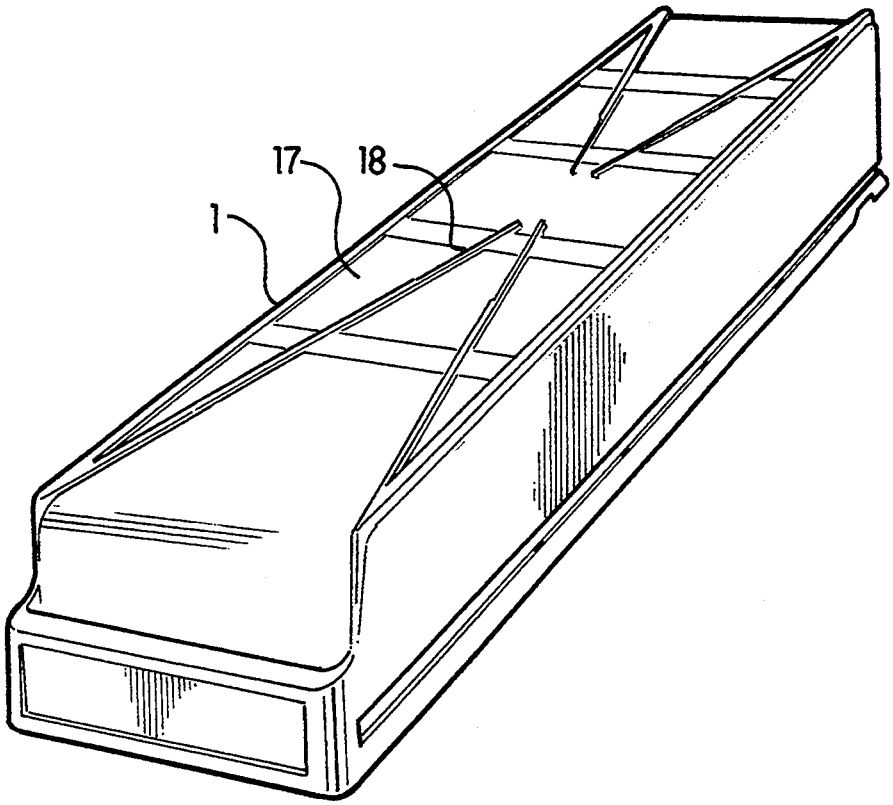

FIG. 7 shows one embodiment of the outer side of the bottom of the container.

Figure 1:
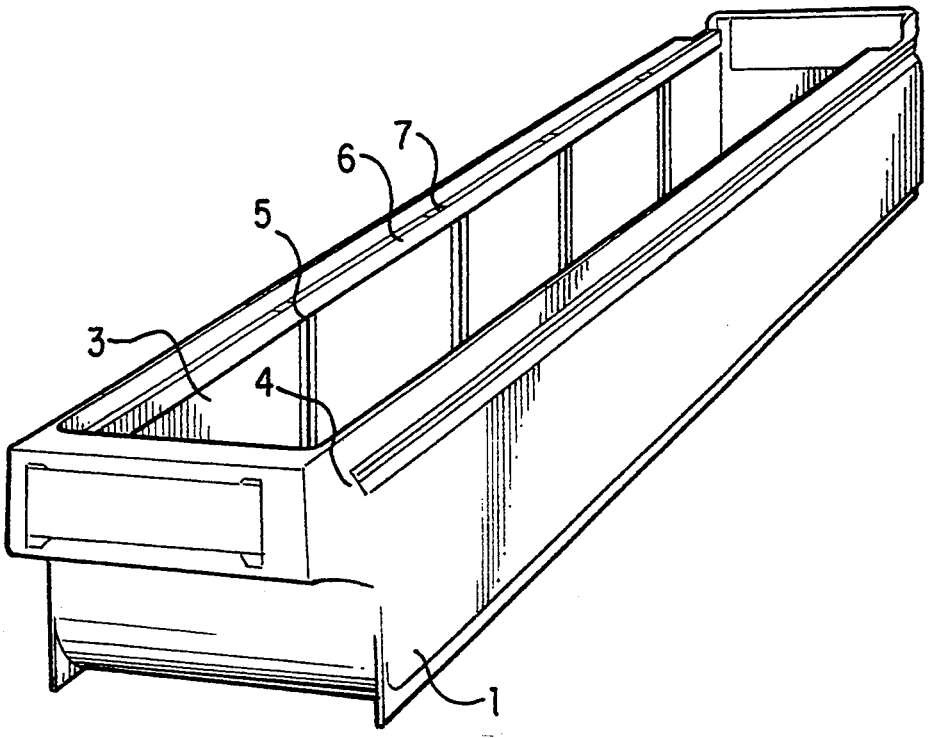

The storage container 1 (FIG. 1) which comprises separate detachable partition walls 2 is provided with opposite vertical recesses or pairs of vertical ledges 5 along the inner side of the two long sides 3 and 4. At the top the container 1 is provided with an inwards directed horizontal ledge 6 along each of the two long sides 3 and 4. Locking means 7 are arranged in the upper edge of the ledges 6 on the two long sides 3 and 4 of the container 1, in connection with each recess or pair of ledges 5.

Figure 2:
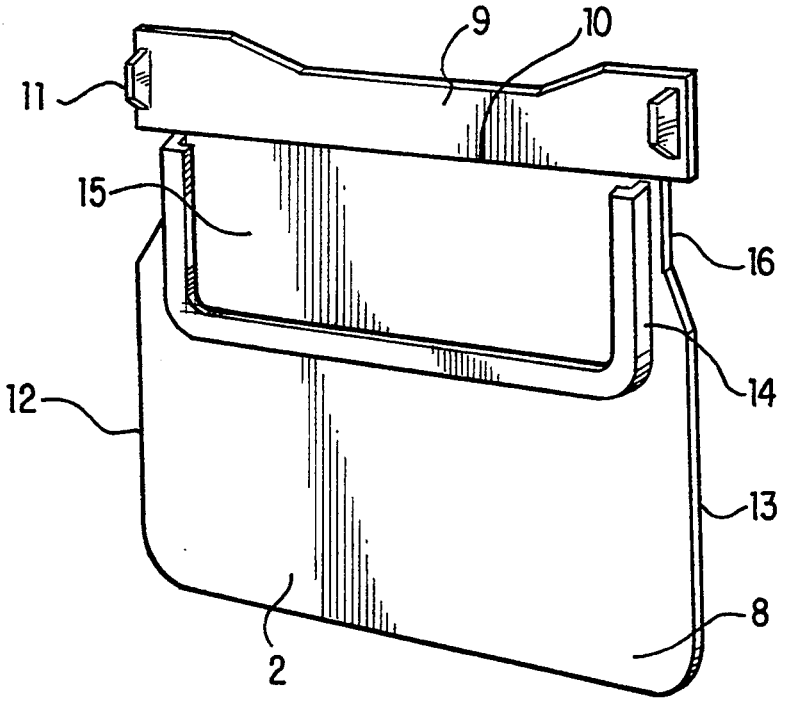
FIG. 2 shows a perspective view of one embodiment of a partition wall.

The partition walls 2 (FIG. 2) comprise a lower part 8 and an upper part 9 which are connected to each other by an integrated hinge 10. The parts 8, 9 and 10 are made of plastic and in one piece. The upper part 9 is fitted with locking means 11 along each short side. The locking means 11 are intended to co-operate with the locking means 7 on the container 1.

Figure 3:
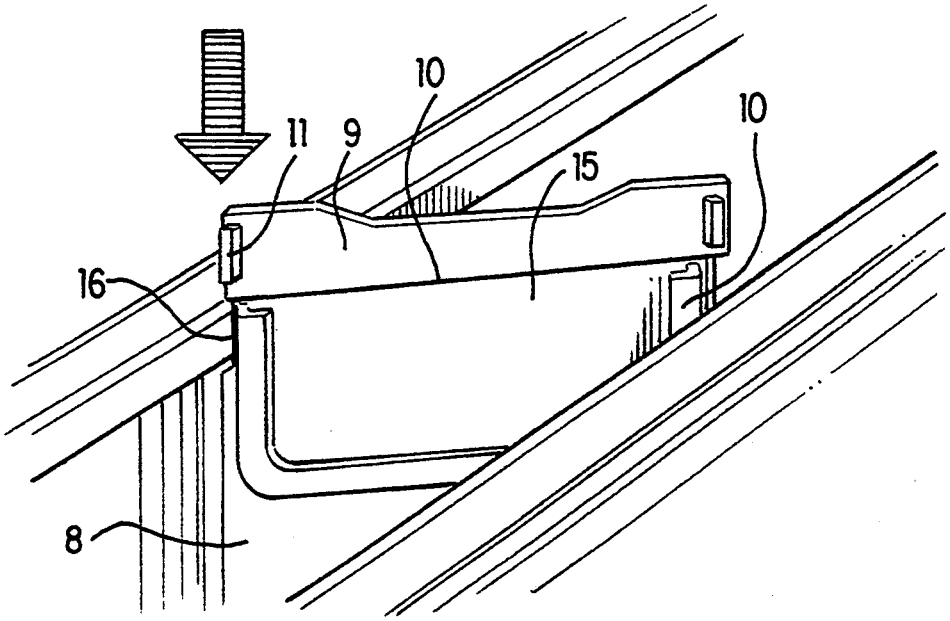
FIGS. 3 to 4 show how the partition wall can be placed in vertical recesses or pairs of ledges.

FIG. 3 shows how a partition wall 2 is installed in the container 1 by introducing it from above into the container and then moving it at an oblique angle with the long sides 3, 4. The lower part 8 of the partition wall is provided with recesses 16 at the top corresponding to the shape of the ledges 6.

Figure 4:
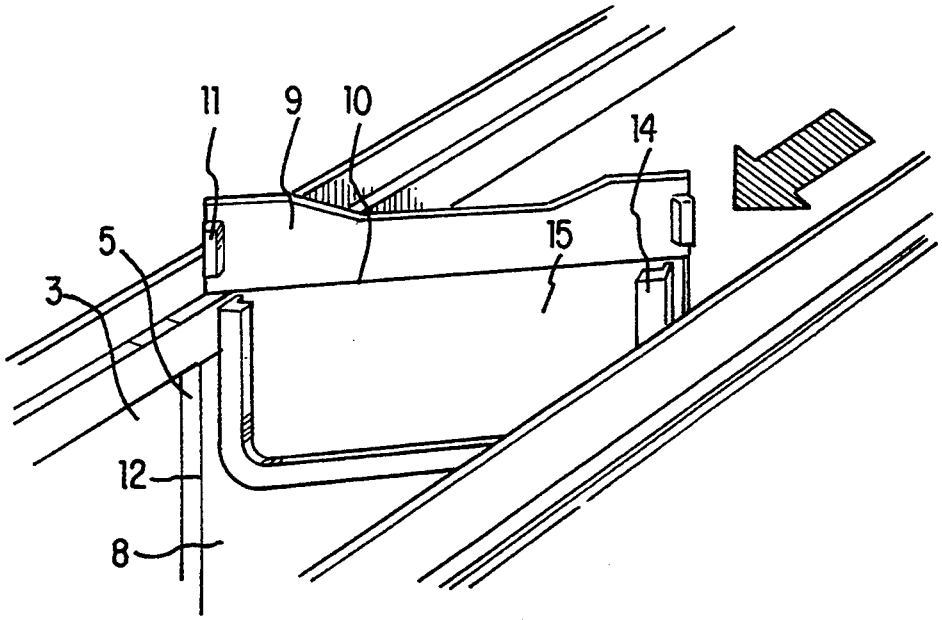

FIG. 4 illustrates how one edge 12 of the partition wall 2 is inserted into a vertical recess or between a pair of vertical ledges 5 on the inner side of the long side 3 of the container, whereupon the opposite edge 13 of the partition wall 2 is pushed from the side into its corresponding recess or between a pair of ledges 5 on the inner side of the other long side 4.

The lower part 8 of the partition wall 2 is equipped with a label holder 14 (FIG. 5) at the top. A label 15 placed in the label holder 14 is kept in place when the upper part 9 of the partition wall 2 is folded along the hinge 10 at an angle of 90° with the lower part 8, whereupon the locking means 11 on the partition wall 2 is brought in engagement with the locking means 7 on the container 1 (FIG. 6).

Here the locking means co-operate by snap-in action, whereby the locking means 11 preferably consist of snap-in heads and the locking means 7 consist of recesses in the upper edge of the inwards directed horizontal ledges 6 on the container 1.

The outer side of the bottom 17 of the container 1 is furnished with diagonal reinforcement ribs 18 which are lower in the middle of the container than at the ends.

Moreover, the ribs are interrupted just before the crossing of the diagonals.

The invention is not limited to the embodiments shown since these can be modified in different ways within the scope of the invention.

I claim:

1. In a storage container which comprises a storage tray made of a plastic material and at least one detachable partition, said storage tray comprising four side walls and a bottom, two of said side walls being longer than the other two side walls and said longer side walls being opposed to each other and being connected to said other two side walls, said bottom being attached on its outer edge to bottom portions of the side walls, said tray being provided with at least one pair of opposed vertical recesses along opposite sides of the longer side walls, said vertical recesses being generally perpendicular to the bottom, each of said longer side walls further comprising opposed horizontal ledges along an upper portion of each longer side wall remote from the bottom, each of said horizontal ledges further comprising locking means, the improvement comprising:

(a) the at least one detachable partition comprising a lower part and an upper part which are connected to each other by an integral hinge, whereby the lower part and the upper parts and the hinge are made of a plastic material and are in one piece;

(b) the upper part of each partition being provided with partition locking means, said partition locking means interacting with said horizontal ledge locking means; and (c) the at least one partition being shaped so as to be installable in the tray by inserting the lower portion of the partition into the recesses of the tray, the upper part of the partition being foldable at an angle of about 90° to the lower part of the partition thereby bringing the partition locking means on said portion into engagement with the horizontal ledge locking means.

2. The container according to claim 1, wherein the horizontal ledge locking means and the partition locking means interact by snap-in action, said partition locking means comprising snap-in heads and said horizontal ledge locking means comprising locking recesses.

3. The container according to claim 1 or 2, wherein the lower part of the partition is provided with a label holder for holding a label, such that when the label is placed in the label holder, the label is held in place by folding the partition at the hinge, securing the upper part of the partition to the tray by the partition locking means and the horizontal ledge locking means.

4. The container according to claim 1 or 2, wherein the lower part of the partition is provided with partition recesses which correspond in shape to the horizontal ledges on the tray.

5. The container according to claim 1 or 2, wherein the bottom of the tray comprises two faces, the first face being surrounded by the four side walls and the second face being opposite said first face, said second face being provided with reinforcing ribs.

6. The container according to claim 5, wherein the reinforcing ribs are diagonal on the second face of the bottom, extending from corner to corner.

7. In a storage container which comprises a storage tray made of a plastic material and at least one detachable partition, said storage tray comprising four side walls and a bottom, two of said side walls being longer than the other two side walls and said longer side walls being opposed to each other and being connected to said other two walls, said bottom being attached on its outer edge to the bottom portions of the side walls, said tray being provided with at least one pair of opposed vertical ledges along opposite sides of the longer side walls, said vertical ledges being generally perpendicular to the bottom, each of said longer side walls further comprising opposed horizontal ledges along an upper portion of each longer side wall remote from the bottom, each of said horizontal ledges further comprising locking means, the improvement comprising:

(a) the at least one detachable partition comprising a lower part and an upper part which are connected to each other by an integral hinge, whereby the lower part and the tipper parts and the hinge are made of a plastic material and are in one piece;

(b) the tipper part of each partition being provided with partition locking means, said partition locking means interacting with said horizontal ledge locking means; and (c) the at least one partition being shaped so as to be installable in the tray by inserting the lower portion of the partition between the ledges of the tray, the upper part of the partition being foldable at an angle of about 90° to the lower part of the partition thereby bringing the partition locking means into engagement with the horizontal ledge locking means.

8. The container according to claim 7, wherein the horizontal ledge locking means and the partition locking means interact by snap-in action, said partition locking means comprising snap-in heads and said horizontal ledge locking means comprising locking recesses in the horizonal ledges of the tray.

9. The container according to claim 7 or 8, wherein the lower part of the partition is provided with a label holder for holding a label, such that when the label is placed in the label holder, the label is held in place by folding the partition at the hinge, securing the upper part of the partition to the tray by the partition locking means and the horizontal ledge locking means.

10. The container according to claim 7 or 8, wherein the lower part of the partition is provided with partition recesses which correspond in shape to the horizontal ledges on the tray.

11. The container according to claim 7 or 8, wherein the bottom of the tray comprises two faces, the first lace surrounded by the four side walls and the second face being opposite said first face, said second lace being provided with reinforcing ribs.

12. The container according to claim 11, wherein the reinforcing ribs are diagonal on the second face of the bottom, extending from corner to corner.

* * * * *